United States Patent [19]

Cretella

[11] 4,016,683

[45] Apr. 12, 1977

[54] TURBINE BLADE EDGE GRINDER

[76] Inventor: Salvatore J. Cretella, 180 Fitch St., North Haven, Conn. 06473

[22] Filed: Oct. 23, 1975

[21] Appl. No.: 625,071

[52] U.S. Cl. ..... 51/143; 51/96; 51/234

[51] Int. Cl.[2] ..... B24B 21/00

[58] Field of Search ..... 51/46, 96, 143, 144, 51/234

[56] References Cited

UNITED STATES PATENTS

| | | | |
|---|---|---|---|
| 2,212,179 | 3/1976 | Martin | 51/96 |
| 2,771,723 | 11/1956 | Burleson | 51/234 X |
| 3,335,527 | 8/1967 | Sabine | 51/96 |
| 3,434,245 | 3/1969 | Stuart | 51/234 X |
| 3,521,410 | 7/1970 | Windefors | 51/144 |

*Primary Examiner*—Harold D. Whitehead
*Attorney, Agent, or Firm*—H. Gibner Lehmann; K. Gibner Lehmann

[57] ABSTRACT

A machine for resurfacing the leading edge portions of worn or cracked turbine blades and the like, comprising a machine bed, a power driven abrasive belt extending around multiple pulleys disposed above the bed, and a carriage movable over the bed in directions toward and away from the belt. A clamping fixture is pivotally mounted on the carriage and includes a pair of vises for gripping the opposite end portions of the blade to be resurfaced. Powered means are provided for imparting a periodic reverse rocking movement to the fixture while the carriage is being moved toward the belt. The arrangement is such that the blade engages the belt while undergoing simultaneous swiveling or rocking movement, this resulting in a precision removal of controlled amounts of the blade along the curved contour at its leading edge.

10 Claims, 10 Drawing Figures

27
32
26
30
28
24
130
141
137
139
134
132
135

141
134
132
130
139
137

28
24
32
26
27
30

12

TURBINE BLADE EDGE GRINDER

BACKGROUND

This invention relates generally to refinishing or grinding machine and more particularly to devices of this type which are adapted to impart a desired, predetermined contour to portions of a workpiece, such as a turbine blade or the like.

After a period of use, the blades employed in turbine engines tend to become worn along their leading edges due to heat and abrasion from particles of sand or debris which are encountered during operation. In addition, small surface cracks can develop in the vicinity of the leading edges. When these occur, it is necessary to replace or repair the blade since such cracks will in time deepen and ultimately cause failures. Because the fabrication of these blades is expensive, involving close tolerances and special metal alloys, it has been found desirable to refinish worn or damaged blades whenever possible, instead of merely discarding them and substituting new units. Generally the blade surface is ground down at the worn area, until the cracks disappear. It has been found that removal of only minute amounts of metal, resulting in a slight undersize in the blade dimensions, refurbishes the blades so that they can again be placed in use. One of the problems encountered in removing controlled amounts of material is that it has been difficult to judge how much metal has been removed after the process has begun. In addition, achieving good uniformity from one unit to another is not had when the grinding or resurfacing is done by hand. In the latter case, it is likely that too little material will be removed on certain portions of the blade, with too much being ground off at other areas. As a rule, the leading edge on the blade is rounded along a relatively small radius, and it has been found that resurfacing such edges is exceedingly difficult to accomplish by hand, in view of the close tolerances involved.

SUMMARY

The above drawbacks and disadvantages of prior resurfacing devices are obviated by the present invention, which has for an object the provision of a novel and improved machine for precisely resurfacing portions of a turbine blade, the machine being simple in construction, reliable in operation, and capable of attaining highly accurate and uniform results from one unit to the next. A related object is the provision of a machine as above, which involves no complex set-up procedures, and which requires a minimum of judgement on the part of the operator, thereby tending to reduce operator-related error.

The above objects are accomplished by the provision of a novel turbine blade resurfacing machine comprising a machine bed, a power driven resurfacing device including an abrasive member disposed above the bed, a carriage movable over the bed and advanceable toward the belt, and a clamping fixture pivotally mounted for reverse rocking movements on the carriage and having a vise adapted to hold the blade being resurfaced. Powered means are provided for effecting the reverse movement of the fixture while the carriage is being advanced toward the abrasive member. The arrangement is such that the abrasive member engages the leading edge of the blade while the latter is simultaneously being rocked, thus enabling the removal of only carefully controlled quantities of the blade edge along a curved or rounded contour.

Other features and advantages will hereinafter appear.

In the drawings, illustrating a preferred embodiment of the invention:

Figures 5, 6, 7, 8:
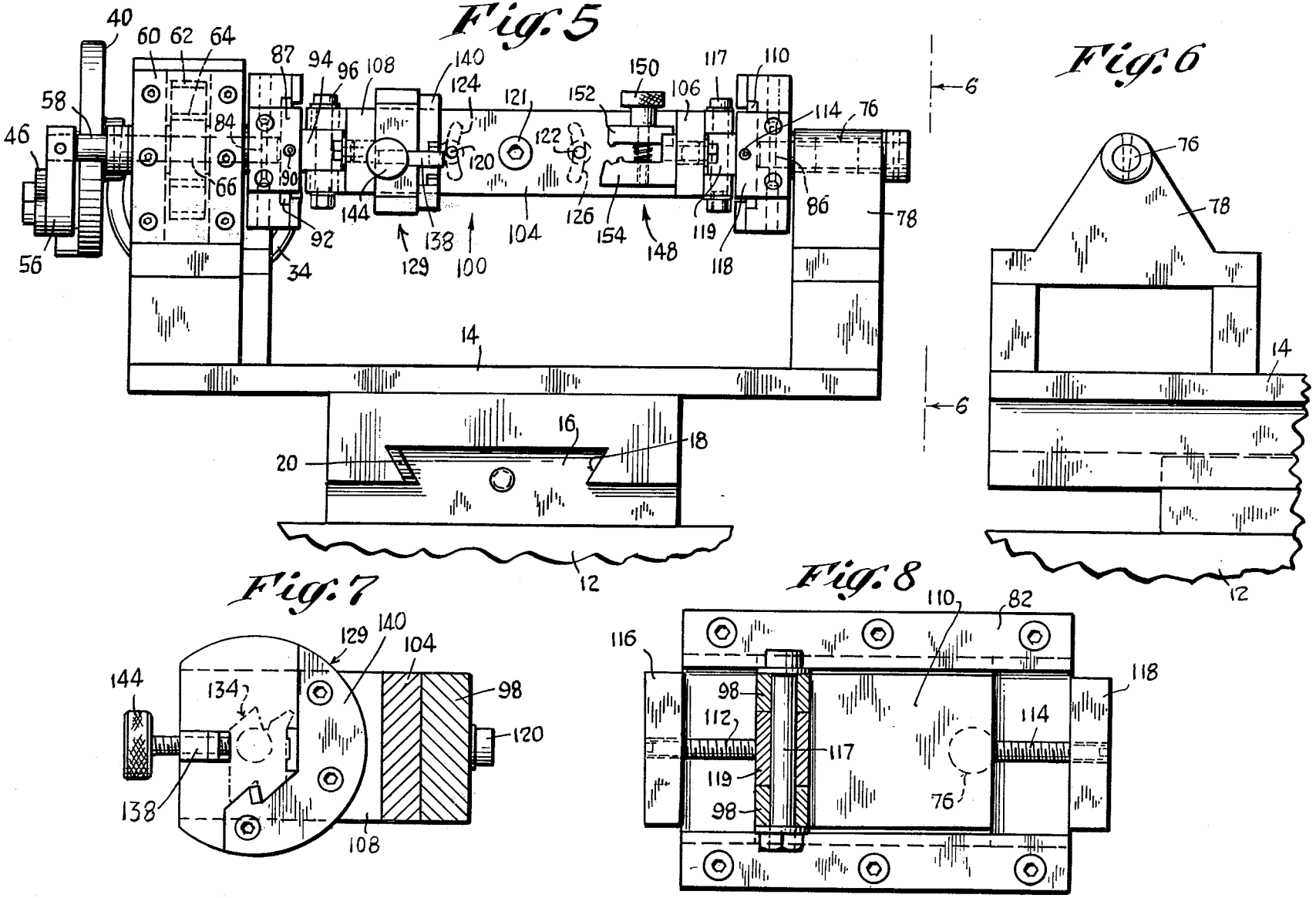
FIG. 5 is a rear elevational view of the resurfacing machine of FIGS. 1–4.
FIG. 6 is a view taken on line 6—6 of FIG. 5.
FIG. 7 is a section taken on line 7—7 of FIG. 1.
FIG. 8 is a section taken on line 8—8 of FIG. 1.

Referring first to FIGS. 1–6 and in accordance with the present invention there is illustrated a novel and improved machine for resurfacing a turbine blade by removing controlled quantities of its leading edge along a specified contour, comprising a bed or base 12 carrying a slidable carriage generally designated 14. As shown in FIG. 5, the base has a dovetail 16 which is received in a slide groove 18 in the carriage. A take-up shoe 20 removes all play and provides a smooth sliding fit. Movement of the carriage 14 with respect to the base is accomplished by a lead screw 21 which carries a crank handle 22.

Figures 2, 4, 9, 10:
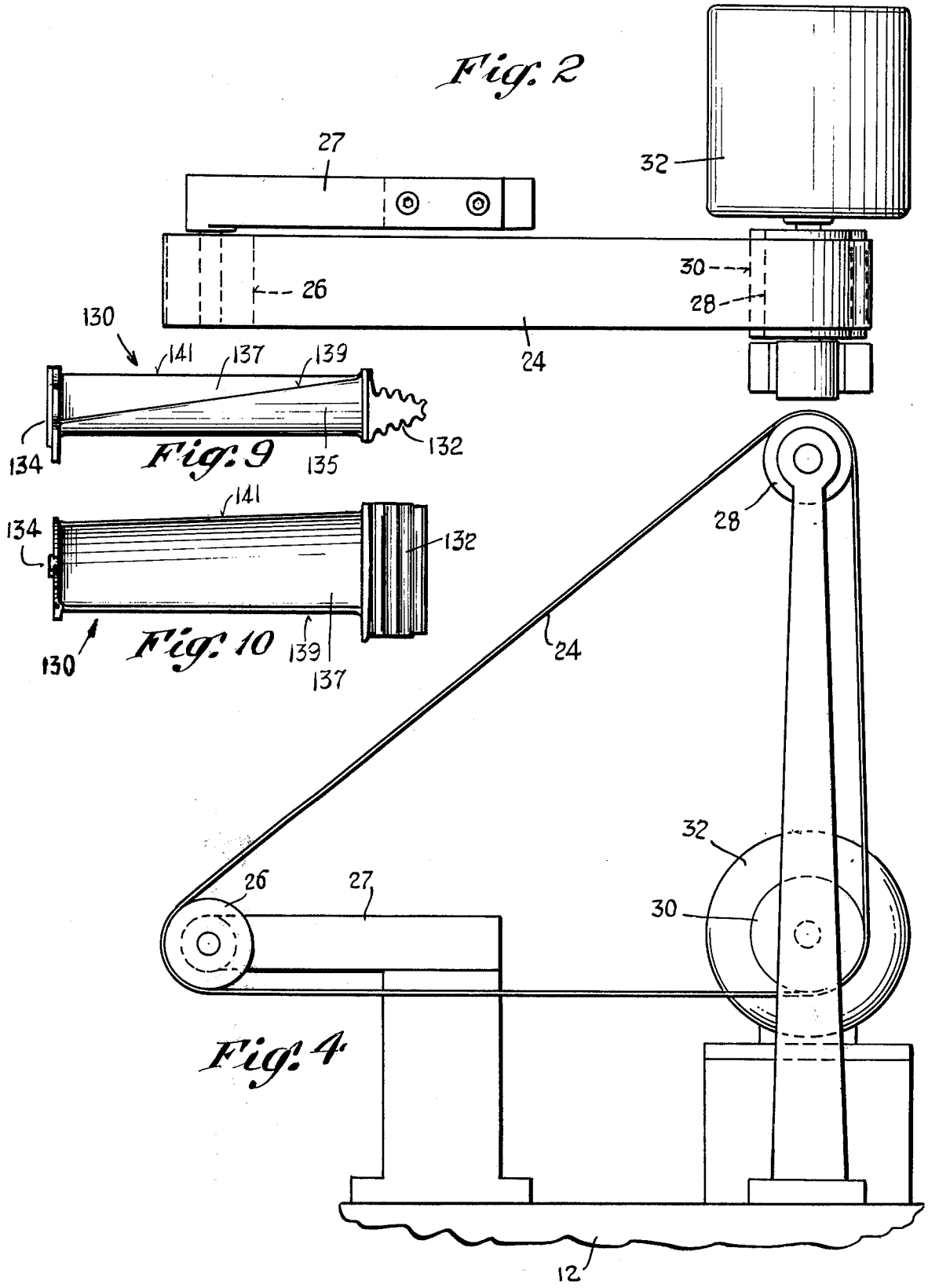
FIG. 2 is a fragmentary top plan view of the resurfacing machine of FIG. 1, showing the abrasive member and driving arrangement therefor.
FIG. 4 is a fragmentary side elevational view of that portion of the resurfacing machine shown in FIG. 2.
FIG. 9 is a side elevational view of a typical turbine blade, showing particularly the leading edge portion thereof.
FIG. 10 is a bottom plan view of the turbine blade of FIG. 9, showing its concave under surface and its trailing and leading edges respectively.

As particularly shown in FIGS. 2 and 4, also carried on the base 12 is an abrasive member in the form of a sanding belt 24 which extends around three pulleys 26, 28 and 30, the pulley 26 being disposed adjacent one end of the path of movement of the carriage 14 and mounted on an arm 27, and the pulley 28 constituting an idler. Pulley 30 is connected to an electric motor 32 mounted on the base 12, for driving the belt 24.

Referring again to FIGS. 1 and 3, the carriage 14 carries a second electric motor 34 having its output shaft driving a gear reduction mechanism 36. The output shaft 38 of the latter in turn carries a crank wheel 40 which rotates in the direction shown in FIG. 3 at a greatly reduced rate, typically one revolution per second. Mounted on the wheel 40 is an adjustment slide 42 which is secured by a pair of small plates 44 bolted to the wheel as shown. The slide 42 is disposed off-center with respect to the wheel 40 and carries a drive link or crank arm 46. Also mounted on the wheel are two upstanding blocks 48, 50 which respectively carry set screws 52, 54 for effecting adjustment of the eccentricity of the slide plate 42 with respect to the wheel axis.

Figure 1:
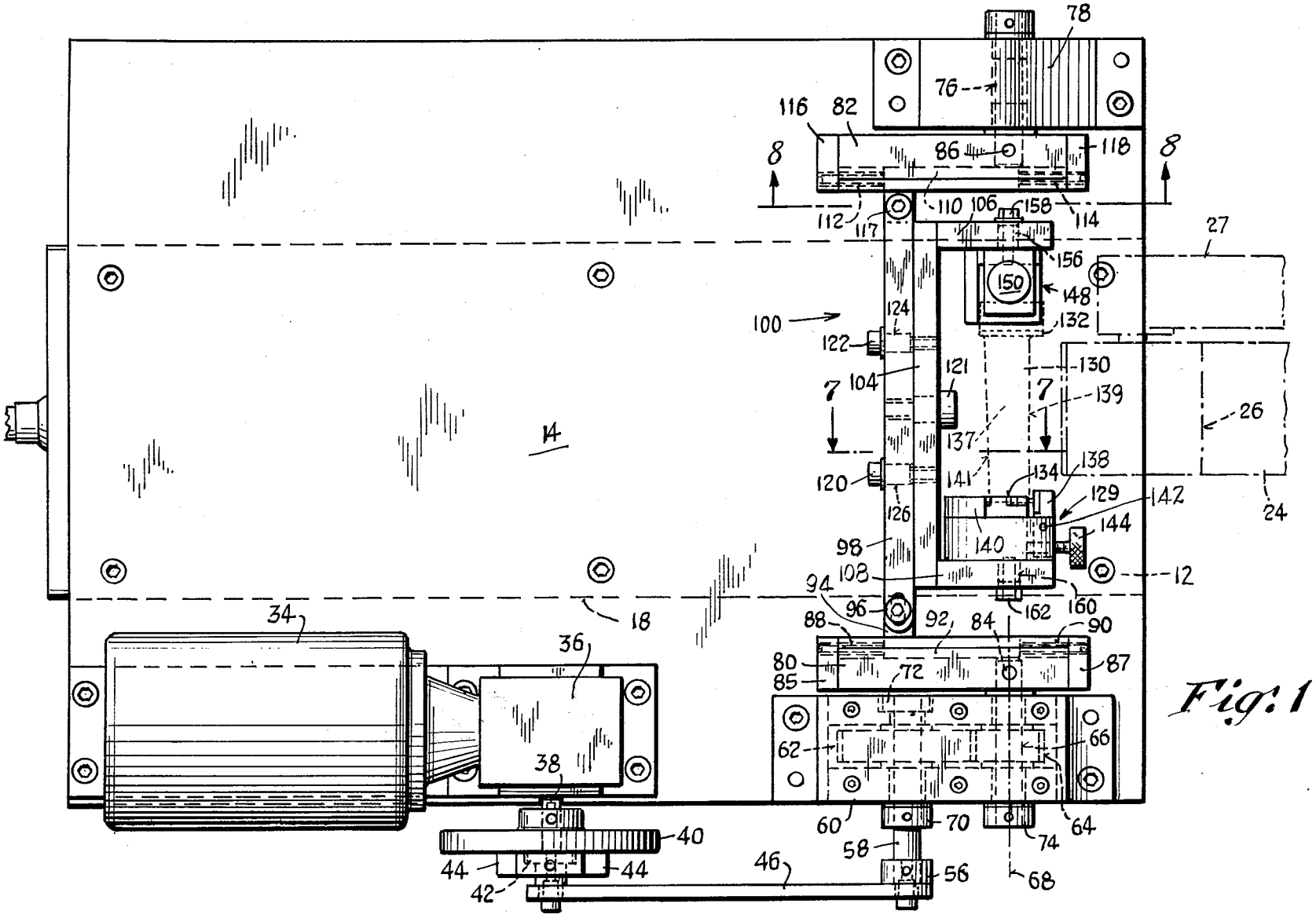
FIG. 1 is a fragmentary top plan view of the improved resurfacing machine of the present invention, showing particularly the carriage and clamp fixture of the device.

Pivotally connected to the other end of the link 46 is a second crank arm 56 which is carried on a shaft 58 turnably mounted in a bearing block 60. The latter is rigid with respect to the carriage 14 as shown. Disposed inside the block 60 and rigid on the shaft 58 is a drive gear 62 which engages a driven gear 64, the latter being carried on a second shaft 66 which is rotatable about an axis 68 (FIG. 1). Shaft 58 is secured against axial movement by collars 70, 72, and shaft 66 is similarly secured by a collar 74.

A second bearing block 78 is mounted on the carriage 14 and carries a shaft 76 which is aligned with the shaft 66. Two end blocks 80, 82 are mounted on the shafts 66, 76 respectively by means of pins 84, 86.

Disposed at opposite ends of the block 80 are end caps 85, 87 which have threaded holes receiving adjustment set serews 88, 90 respectively. These in turn engage the opposite ends of an adjustment slide 92 which is movable with respect to the block 80. The slide includes a hinge part 94, and a hinge pin 96 pivotally secures the part 94 to the base 98 of a holder or clamp fixture 100. The latter in turn carries a yoke comprising a base 104 and two legs 106, 108. The other end of the base 98 is pivotally secured to the hinge part 119 of a second slide 110, which is adjustably carried in the end block 82. A hinge pin 117 extends through aligned apertures in the base 98 and hinge part 119. Set screws 112, 114 are carried in the end caps 116, 118 respectively of the end block 82, to enable adjustment of the position of the slide 110 with respect thereto. This construction is shown particularly in FIG. 8. The one aperture which is at the end of the base 98 and which receives the pin 96 is seen to be elongate, to enable limited movement of the base 98 in a direction transverse to the paths of movement of the slides 92, 110. This prevents binding during the adjustment of the positions of the latter.

Referring again to FIGS. 1 and 5, the base 104 of the yoke is secured to the base 98 of the fixture by means of a pivot screw 121, and adjustment screws 120, 122. In addition, the base 98 includes arcuate slots 124, 126 which enable tilting of the two bases with respect to one another, in order to effect proper positioning of a holder structure to be described below.

Referring again to FIGS. 1, 5 and 7, there is carried on the leg 108 a clamping device in the form of a vise 129 for holding one end of a turbine blade. A typical blade 130 is illustrated in FIG. 9, and consists of a ribbed end flange 132 and a transverse end flange 134. The body includes a convex surface 135, a concave surface 137, and leading and trailing edges 139, 141 respectively. The transverse end flange 134 is adapted to be clamped between the jaws 138, 140 of the vise; a pivot pin 142 extends through the jaw 138, and tightening of the vise is accomplished by backing off on the screw 144. The configuration of the jaws 138, 140 enables them to tightly engage the transverse end flange 134. Similarly, an additional vise 148 is carried on the other leg 106 of the yoke. This vise includes jaws 152, 154, and is adapted to clamp the ribbed end flange 132 of the blade. Tightening is accomplished by means of a screw 150 passing through the upper jaw 152 (FIG. 5) and extending into a threaded hole in the lower jaw 154.

The vise 129 includes an internally threaded, hollow extension or boss 160 which is received in a recess in the leg 108. A screw 162 is carried in the boss 160 and secures the vise in a fixed position. Similarly, the vise 148 includes an internally threaded boss 156 which is received in a recess in the leg 106, with a screw 158 securing the vise in a fixed position.

The operation of the improved resurfacing machine of the present invention can now be readily understood. With the turbine blade 130 clamped in position in the vises 129, 148, such that its leading edge 139 is disposed toward the belt 24, the motor 32 can be energized to run the latter. If the second motor 34 is then energized, the crank wheel 40 will be driven in the direction shown, at a fairly slow rate due to the speed reduction provided by the gear box 36. This in turn drives the link 46 which effects reciprocation or oscillating movement of the second crank arm 56. This oscillatory movement of shaft 58 is transmitted to the second shaft 66 through the spur gears 62, 64. Due to the fact tht the gear 64 has fewer teeth than the gear 62, the shaft 66 moves through a substantially larger angle than that of the shaft 58. This reversing movement or rocking is thus transmitted through the end block 80 and base 98 to the yoke 104 and vises 129, 148. With the blade undergoing such rocking, the operator can manually adjust the position of the carriage 14 by means of the crank handle 22 to bring the rounded leading edge 139 into engagement with the belt 24 while the blade is being rocked. In this way, minute but controlled amounts of the leading edge can be removed along a contour which approximates that of the original surface. Periodically, during the grinding operation the operator retracts the carriage removes the blade and places it in a master gauge to take readings of the remaining surface dimensions. In this manner, excellent uniformity between a number of units of the same batch is obtained, and the likelihood of error due to misjudgements on the part of the operator is greatly reduced. When the desired amount of material has been ground off the blade, it can be removed and replaced by another worn blade on which the above operations can then be performed.

Figure 3:
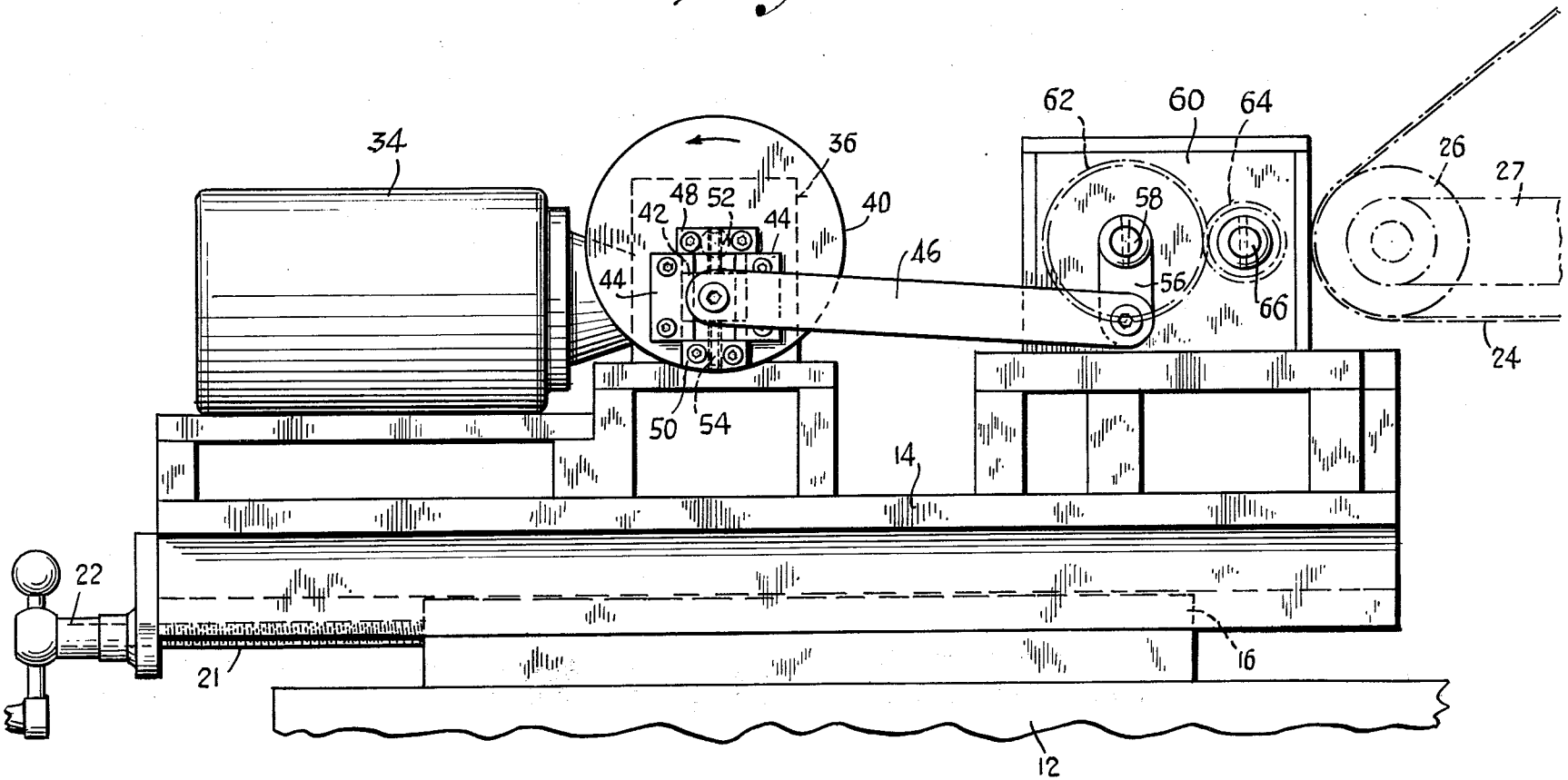
FIG. 3 is a fragmentary side elevational view of that portion of the resurfacing machine shown in FIG. 1.

The above construction is seen to readily provide for making initial adjustments during setting up of the machine. The angular displacement of the holder or clamp fixture is determined by the setting or position of the adjustment slide plate 42 with respect to the center or axis of the crank wheel 40. As illustrated in FIG. 3, the plate 42 can be shifted along a radius of the wheel 40 by means of the two adjustment screws 52, 54. As can be readily understood by referring to FIG. 3, shifting the plate 42 toward the center of the wheel 40 will have the effect of shortening the stroke of the drive link 46. This in turn will reduce the angular displacement of the fixture 100 on each half cycle of its reciprocation. Conversely, shifting the plate 42 in a direction away from the axis of the wheel 40 will have the effect of lengthening the stroke of link 46, thus increasing the angular displacement of the fixture 100. The proper setting depends upon the configuration of the blades and the degree of resurfacing desired.

Referring now to FIGS. 1 and 8, adjustment of the axis of the holder fixture 100 is made possible by the particular arrangement of the slides 92, 110 which are movable in the end blocks 80, 82, respectively. This enables not only a lateral shifting of the fixture 100 with respect to the axis 68 (FIG. 1) of the aligned shafts 66, 76, but also tilting of the fixture, via independent movement of the slides. The hinge connections between the base 98 and the slides 92, 110 enables such tilting to occur. In addition, the aperture in the base 98 which receives the pin 96 is slotted, to enable free canting of the base 100 when it is desired to reposition either of the slides.

Adjustment of the position of the yoke 102 with respect to the base 100 is readily accomplished by loosening the screws 120, 122 which occupy the arcuate slots 124, 126 respectively. Positioning of the vise 129 is accomplished by loosening the screw 162 and tilting the assemblage to the desired position. Adjustment of the vise 148 is accomplished in a similar manner.

The slide 110 which is carried in the end block 82, is shown particularly in FIG. 8. The blocks 80, 82 are substantially identical in construction, and the slide 92 is a mirror arrangement of the slide 110.

From the above it can be seen that I have provided a novel and improved machine for resurfacing the leading edges of turbine blades and the like, the device being simple in construction, reliable in operation and capable of achieving excellent uniformity from unit to unit. A minimum amount of operator judgement is involved, thus reducing error and resultant waste. The machine is thus seen to represent a distinct advance and improvement in the technology of resurfacing machines.

Variations and modifications are possible without departing from the spirit of the invention.

I claim:

1. A machine for resurfacing portions of a turbine blade, comprising in combination:

a. a machine bed, b. a resurfacing device carried on the bed, comprising a drum and an abrasive member extending around said drum, c. powered means for driving said device, d. a carriage carried by the bed, e. a clamping fixture turnable about an axis on the carriage, having a clamp adapted to hold a turbine blade being resurfaced, f. means for reversely rocking said fixture about said axis, g. means for moving the carriage over the bed in directions toward and away from the resurfacing device whereby the blade can be brought into engagement with said device while being simultaneously turned, thereby to resurface the blade along a curved contour, and h. mounting means for the clamping fixture, i. said mounting means comprising a pair of end bearings and aligned shafts carried respectively by said bearings, and further including a pair of slides located near opposite ends of the fixture and pivot means connecting each slide to the fixture, for enabling simultaneous lateral adjustment of the fixture and tilting adjustment thereof with respect to the axis of the aligned shafts, j. said pivot means thereby enabling independent movement of the slides without danger of binding thereof.

2. The invention as defined in claim 1, wherein:

a. said pivot means includes at least one pivot pin and means defining an elongate slot in which the pivot pin is movable.

3. The invention as defined in claim 1, wherein:

a. said clamping fixture comprises a base part carried by the shafts and a yoke part carried by the base, part and b. means for adjustably mounting the yoke part to different predetermined positions with respect to the base part.

4. The invention as defined in claim 3, wherein:

a. said adjustable mounting means for the yoke part includes a pivot bearing extending through both the yoke and the base parts, b. one of said parts having slotted holes, and screws carried by the other of said parts and extending into said slotted holes.

5. The invention as defined in claim 4, and further including:

a. a vise carried by said yoke part and adapted to clamp a turbine blade in a predetermined fixed position with respect thereto, b. adjustment means for enabling limited canting of the vise with respect to the yoke part, during adjustment.

6. The invention as defined in claim 1, wherein:

a. said mounting means further comprises an end block carried by one of said aligned shafts, b. one of said slides being carried by the end block and being movable in directions transversely of the axis of said one shaft, c. shifting of the slide effecting tilting of the clamping fixture with respect to the axis of the aligned shafts.

7. The invention as defined in claim 6, and further including:

a. an additional end block carried by the other of said aligned shafts, and b. another of said slides being carried by the additional end block and also being movable in directions transversely of the axis of the said aligned shafts, c. shifting of the slides effecting simultaneous tilting and lateral movement of the clamping fixture with respect to the axis of the aligned shafts.

8. The invention as defined in claim 1, and further including:

a. adjustable means for varying the extent of reverse rocking movement of the clamping fixture.

9. The invention as defined in claim 8, wherein:

a. said adjustable means comprises a rotary crank wheel, and b. a link pivotally connected to the crank wheel, c. said wheel including a slide movable with respect to the axis of rotation of said crank wheel, shifting of the slide altering the stroke of the link.

10. The invention as defined in claim 1, wherein:

a. said rocking means comprises a reversing drive gear on said carriage, and b. a reversing driven gear connected for rocking said fixture, c. the number of teeth on said drive gear being greater than the number on said driven gear, providing a higher angular displacement of said driven gear and for a given angular displacement of said drive gear, d. said powered means comprising an electric motor for operating said drive gear.

* * * * *